US008925841B2

(12) United States Patent
Jensen et al.

(10) Patent No.: US 8,925,841 B2
(45) Date of Patent: Jan. 6, 2015

(54) ZERO WATT STANDBY ENERGY CONSUMPTION APPARATUS

(75) Inventors: Michael D. Jensen, Round Lake, IL (US); Adam Kadolph, Batavia, IL (US)

(73) Assignee: Fellowes, Inc., Itasca, IL (US)

( * ) Notice: Subject to any disclaimer, the term of this patent is extended or adjusted under 35 U.S.C. 154(b) by 708 days.

(21) Appl. No.: 13/227,993

(22) Filed: Sep. 8, 2011

(65) Prior Publication Data

US 2013/0062444 A1 Mar. 14, 2013

(51) Int. Cl.

| | |
|---|---|
| ***B02C 7/04*** | (2006.01) |
| ***B02C 23/00*** | (2006.01) |
| ***B02C 18/00*** | (2006.01) |
| ***B02C 25/00*** | (2006.01) |

(52) U.S. Cl.

CPC ..... *B02C 25/00* (2013.01); *B02C 18/0007* (2013.01); *B02C 2018/0038* (2013.01); *B02C 2018/0023* (2013.01)

USPC ..... 241/36; 241/100; 241/236

(58) Field of Classification Search

USPC ..... 241/100, 236, 36, 37.5

See application file for complete search history.

(56) References Cited

U.S. PATENT DOCUMENTS

| | | | | |
|---|---|---|---|---|
| 6,978,954 | B2 | 12/2005 | Kroger et al. | |
| 7,040,559 | B2 | 5/2006 | Matlin et al. | |
| 7,444,530 | B2 | 10/2008 | Deppe et al. | |
| 7,520,452 | B2 * | 4/2009 | Watano et al. | 241/36 |
| 7,556,212 | B1 * | 7/2009 | Huang | 241/33 |
| 7,698,585 | B2 | 4/2010 | Malik et al. | |
| 7,712,689 | B2 | 5/2010 | Matlin et al. | |
| 7,765,416 | B2 | 7/2010 | Zhou | |
| 7,823,816 | B2 | 11/2010 | Jensen | |
| 7,843,088 | B2 | 11/2010 | Perper et al. | |
| 7,971,812 | B2 * | 7/2011 | Huang | 241/36 |
| 8,288,897 | B1 * | 10/2012 | Lo | 307/131 |
| 2010/0059612 | A1 | 3/2010 | Huang | |
| 2010/0152912 | A1 | 6/2010 | Huang | |
| 2013/0037637 | A1 * | 2/2013 | Chen et al. | 241/25 |

OTHER PUBLICATIONS

McConnel, LinkZero-AX Switching IC Cuts Standby Waste to Zero, EETimes Products, Product Review, Oct. 14, 2010.

Garnham, Fujitsu Siemens Unveils 'Zero Watt' Monitors, PC Advisor, Business Center, Aug. 13, 2008.

GoECOlife GXC185Pi Under Desk Shredder cross-cut manual, Jan. 2011.

* cited by examiner

*Primary Examiner* — Faye Francis

(74) *Attorney, Agent, or Firm* — Pillsburg Winthrop Shaw Pittman LLP

(57) ABSTRACT

An electrical appliance, such as a shredder, having low standby power consumption is provided. A power isolation circuit is positioned to electrically disconnect electronic components of the shredder from the shredder's primary power source. An auxiliary power source may generate or store power for powering electronic components, such as sensors or processors, while the primary power source is disconnected. A power isolation controller may use a timer, light detector, or user interaction sensors to determine whether to reconnect the primary power source to the electronic components.

24 Claims, 12 Drawing Sheets

ZERO WATT STANDBY ENERGY CONSUMPTION APPARATUS

FIELD OF THE INVENTION

The invention relates to a zero watt standby energy consumption apparatus for reducing power consumption.

BACKGROUND

Power efficiency has become a feature and expectation for modern electronic appliances. Some electronic appliances attempt to reduce power consumption by switching to a standby mode when the appliance is not in use. An electronic appliance such as a shredder may enter a standby mode by ceasing to run any motors or dimming any display screens on the shredder. Even in this state, however, shredder components such as power supplies, photodetectors, LED's, protection circuits, display screens, and sensors may continue to draw power from sources that the shredder is plugged into. Some types of shredders can consume up to two watts per hour or 48 watts per day in standby mode. In light of the increasing number of shredders in use, the amount energy wasted in standby mode, also called vampire power or standby power, is not insignificant.

Standby power drawn by appliances may be eliminated by disconnecting the appliance from its power source when the appliance is not in use. This disconnecting may be done by unplugging a power cord of the shredder or by toggling a mechanical switch that temporarily breaks a conductive path supplying power to the shredder. When the appliance needs to be used again, the user must then replug the power cord or toggle the mechanical switch to restore the conductive path supplying power to the appliance. Such a manual method of reducing power consumption, however, may be too inconvenient or easy to forget.

SUMMARY

One aspect of the embodiments described herein concerns a power-saving appliance. The power-saving appliance may comprise a motor configured to receive power from a primary power source. The power-saving appliance may further comprise a user interaction sensor configured to detect an interaction with the power-saving appliance. The power-saving appliance may further comprise a switch having an electrical connection to the primary power source and an electrical connection to the motor, wherein the motor is configured to receive power from the primary power source through the switch. The switch may be operable to electrically isolate the motor from the primary power source. The switch may be operable to electrically connect, in response to the user interaction sensor detecting the interaction with the power-saving appliance, the motor to the primary power source. The power-saving appliance may further comprise an auxiliary power source electrically connected to the user interaction sensor and configured to output power at a level substantially lower than the power received by the motor from the primary power source.

Another aspect of the embodiments described herein concerns a method of reducing power drawn by a shredder in a power down mode. The shredder may have a shredder mechanism driven by a motor and a housing in which the motor and shredder mechanism are located. The housing may include a throat for feeding at least an article into the shredder mechanism. The method may comprise determining, with a user interaction sensor, whether the shredder is being used. The method may further comprise electrically isolating one or more of the motor, a user input, a user output, a transceiver, a pump, a second sensor of the shredder, or any combination thereof from a primary power source based on whether the shredder is being used. The method may further comprise generating power from an auxiliary power source that is different from the primary power source, wherein the power generated from the auxiliary power source is substantially lower than the power received from the primary power source. The method may further comprise powering the user interaction sensor of the shredder with power generated from the auxiliary power source.

Other objects, features, and advantages of the present disclosure will be apparent from the following description, the accompanying drawings, and the appended claims.

DETAILED DESCRIPTION

Figure 1A:
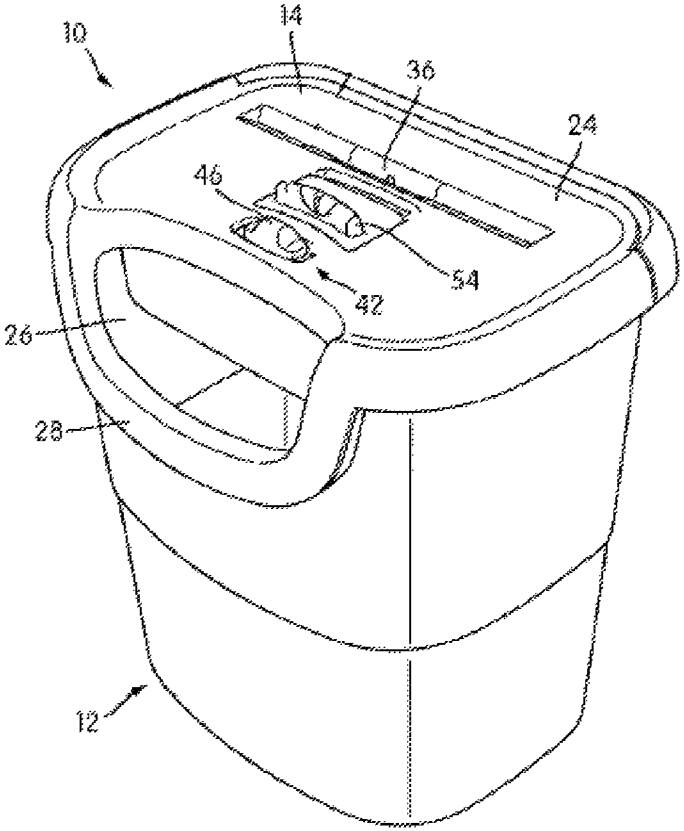
FIG. 1A illustrates an exterior view of a power-saving shredder.

FIG. 1A illustrates an embodiment of a shredder constructed in accordance with one embodiment of the present invention. The shredder 10 sits atop a waste container, generally indicated at 12. The shredder 10 illustrated is designed specifically for use with the container 12, as the shredder housing 14 sits on the upper periphery of the waste container 12 in a nested relation. However, the shredder 10 may be of the type provided with an adaptable mount for attachment to a wide variety of containers. Likewise, the shredder 10 could be part of a large freestanding housing, and a waste container would be enclosed in the housing. An access door would provide for access to and removal of the container. Generally speaking, the shredder 10 may have any suitable construction or configuration and the illustrated embodiment is not intended to be limiting in any way.

The shredder housing 14 may include top wall 24 that sits atop the container 12. The top wall 14 may be molded from plastic and may have an opening 26 near the front thereof, which is formed in part by a downwardly depending generally U-shaped member 28. The opening 26 may allow waste to be discarded into the container 12 without being passed through the shredder mechanism 16, and the member 28 may act as a handle for carrying the shredder 10 separate from the container 12. As an optional feature, this opening 26 may be provided with a lid, such as a pivoting lid, that opens and closes the opening 26. However, this opening in general is optional and may be omitted entirely. Moreover, the shredder housing 14 and its top wall 24 may have any suitable construction or configuration.

The shredder housing 14 may also include a bottom receptacle 30 having a bottom wall, four side walls, and an open top. The shredder mechanism 16 is received therein, and the receptacle 30 is affixed to the underside of the top wall 24 by fasteners. The receptacle 30 has a downwardly facing opening 31 for permitting shredded articles to be discharged from the shredder mechanism 16 into the container 12.

The top wall 24 has a generally laterally extending opening 36 extending generally parallel and above the cutter elements 20. The opening 36, often referred to as a throat, enables the articles being shredded, such as documents, credit cards, CD's, floppy disks, or other items to be fed to the cutter elements 20. As can be appreciated, the opening 36 is relatively narrow, which is desirable for preventing overly thick items, such as large stacks of documents, from being fed into cutter elements 20, which could lead to jamming. The opening 36 may have any configuration.

Figure 1B:
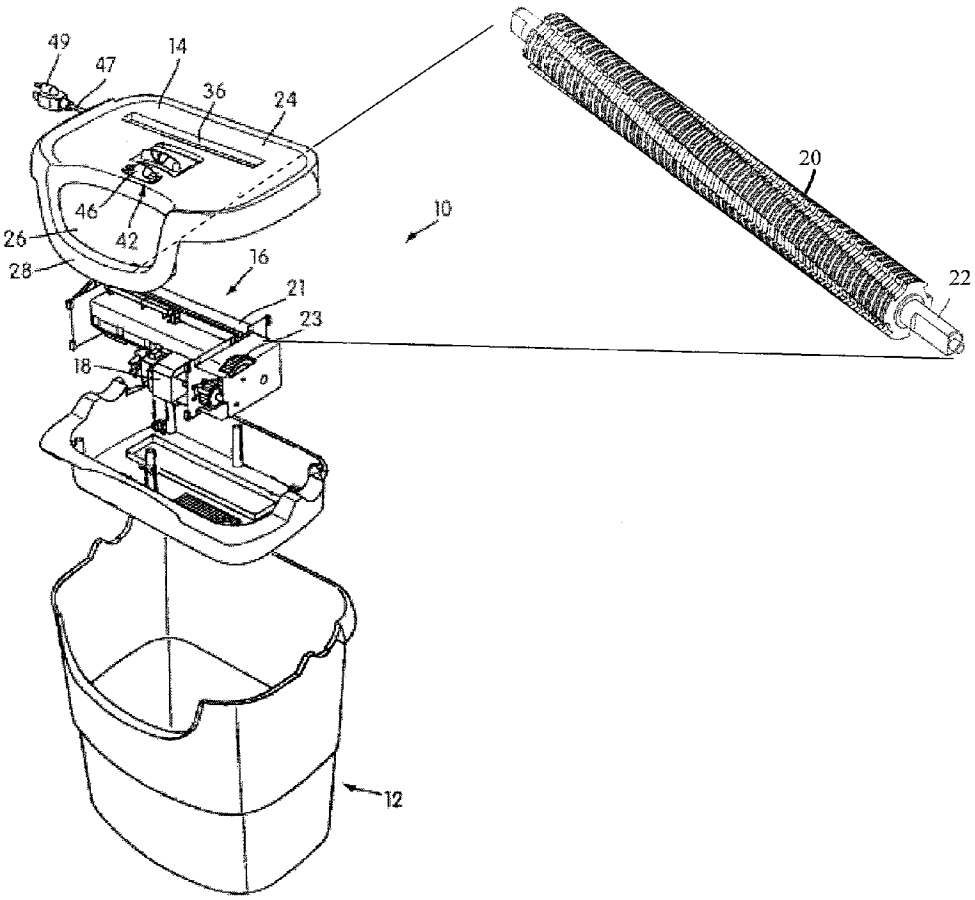
FIG. 1B illustrates an exploded view of a power-saving shredder.

As shown in FIG. 1B, the shredder 10 includes a shredder mechanism 16 including an electrically powered motor 18 and the plurality of cutter elements 20. The cutter elements 20 are mounted on a pair of parallel rotating shafts 22 in any suitable manner. The motor 18 may rotatably drive the shafts 22 and the cutter elements 20 through a conventional transmission 23 so that the cutter elements 20 shred articles fed therein. The shredder mechanism 16 also may include a subframe 21 for mounting the shafts 22, the motor 18, and the transmission 23. The operation and construction of such a shredder mechanism 16 are well known and need not be described herein in detail. Generally, any suitable shredder mechanism 16 known in the art or developed hereafter may be used. The term "shredder" is not intended to be limited to devices that literally "shred" documents and articles, but is instead intended to cover any device that destroys documents and articles in a manner that leaves each document or article illegible and/or useless.

Power may be supplied to the motor through a standard power cord 47 with a plug 49 on its end that plugs into a standard AC outlet, but any suitable manner of power delivery and any suitable power source may be used. The electrical power from the AC outlet may be used to power the motor and other electronic components, including sensors, wireless transmitters or receivers (e.g., for Bluetooth® or WiFi™ communications), pumps, user inputs, user outputs, clocks, memories, and processors.

Sensors may include, for example, a throat sensor (also referred to as an auto-start or presence sensor), a door ajar sensor, a shredder bag full sensor, a proximity sensor, or any other sensor. The throat sensor may be part of a user interaction sensor that detects an article fed by the user into the opening, or throat 36 of the shredder 10. The motor 18 driving the cutting elements 20 may rotate only after a user interaction has been detected by the throat sensor. The throat sensor may require power to, for example, emit infrared, microwave, radio, or light signals toward a receiver to detect the article in the throat, which can be used to begin driving the shredder mechanism. The throat sensor may rely on other modes of detection, such as capacitive or inductive sensing. The throat sensor may also be configured to detect the thickness of the inserted article, or a separate thickness sensor may be used. Reference may be made to U.S. Pat. Nos. 7,631,822; 7,311,276; 7,946,515; and U.S. Patent Publication Nos. 2009/0090797; 2010/0170967; and 2010/0170969 for details and examples of thickness sensors, each of which is incorporated herein in its entirety. The door ajar sensor may draw power to supply current to an electrical loop that is closed only when a shredder door is closed. The proximity sensor may also be part of the user interaction sensor and may supplement the throat sensor. It may, for example, be located on the outside surface of the shredder 10 to detect an approaching user. See U.S. Pat. No. 7,311,276 for details on the proximity sensor, which is incorporated herein in its entirety. It may draw power to implement capacitive or inductive sensing. The sensors may also draw power to amplify signals from a transducer, such as a piezoelectric transducer or a strain gauge, or from a wireless receiver.

Pumps may include, for example, a fluid pump that may require power for drawing lubricating fluid to lubricate the cutter elements 20 of the shredder 10.

User input may include, for example, a touch screen, touch pad, or other soft-touch inputs, which may operate without any mechanical components. User input may also include mechanical controls, such as a mechanical knob or button, that may require power to generate electrical control signals. User input may also include a microphone or camera that may require power to detect and amplify user input. User output may include a LCD or other type of screen, including a touch screen, a LED, a speaker, buzzer, beeper, or a haptic device that may require power for providing an output.

Power may also be supplied to various logic circuits, processors, and memories. A processor and memory, for example, may be powered to render output on the LCD screen. Another memory may be powered to track the usage of the shredder to schedule maintenance or to keep warranty-related statistics. The shredder is not limited to the electronic components illustrated herein, but may incorporate any electronic component or any combination of electronic components. The logic circuits may include a clock that synchronizes operations of the circuits or that tracks the time and date for display to a user.

Figure 2A:
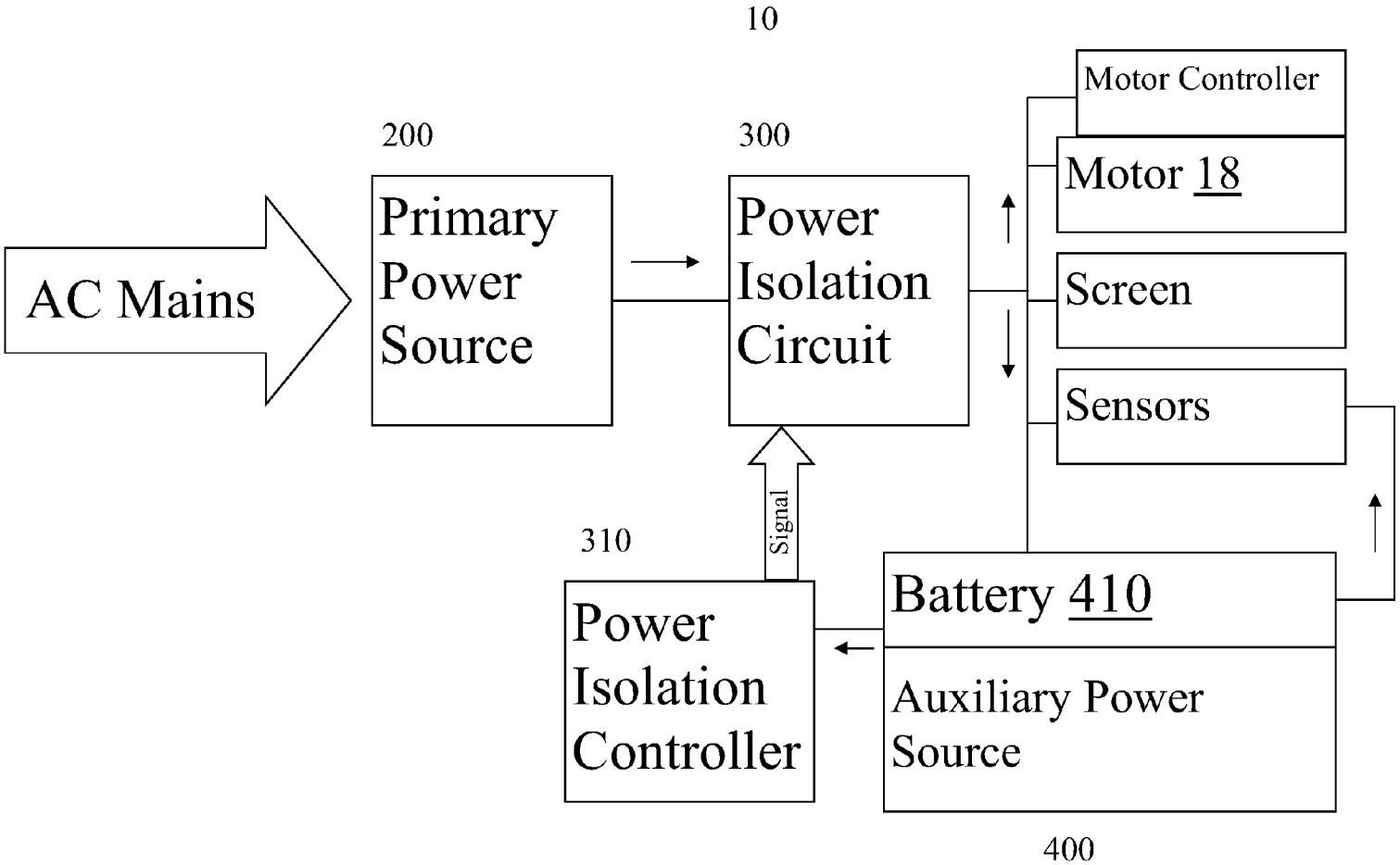
FIG. 2A illustrates a block diagram of components for reducing standby power in a shredder.

FIG. 2A illustrates a block diagram view of a shredder 10 that may reduce its standby power by disconnecting some or all of its components from the shredder's primary power source 200. The primary power source 200 may be an alternating current (AC) power supply that converts AC power from an outlet to a form suitable for the shredder 10. The primary power source 200 may include a transformer that steps down the voltage of the incoming AC power, a rectifier that converts the incoming AC power to DC power, a capacitor that reduces fluctuations in the DC output, or other components that convert the incoming power to a suitable form. In another example, the primary power source 200 may be a switched-mode power supply. While the embodiment in FIG. 2A illustrates a primary power source 200 that interface with AC mains, the primary power source 200 may also convert an incoming source of DC power, such as a battery or fuel cell to a form suitable for the shredder 10. The primary power source 200 may itself be a power source, such as a battery, and have no interface with external sources of power.

The primary power source 200 may be used to power electrical components such as the motor 18, a screen, and sensors. The electronic components may share a portion of a wire or other conductive path that allows current to flow from the primary power source 200 to the electronic components and from the electronic components to the primary power source 200. The screen may be a touch screen configured to detect user input, or may merely display output. The sensors may detect a thickness of an article to be shredded, a shredder door being ajar, a shredder bag or bin being full, a shredder maintenance condition, or any combination thereof. The electrical components that may draw power from the primary power source are not limited to those shown in FIG. 2A. The shredder 10 may include other electrical components, such as pumps, fans, speakers, LED's, light bulbs, haptic devices, microphones, amplifiers, processors, clocks, memories, and other electronic components.

When the shredder 10 is not being used, it may enter into a standby mode. Even in standby mode, however, power may still be drawn by or leaked across electrical components. A touch screen or touchpad, for example, may still require power to detect user inputs, such as an input to resume use of the shredder 10. The throat sensor may still require power to monitor for an insertion of articles in the throat, which may also indicate resumed use of the shredder 10. The proximity sensor may still require power to capacitively or inductively sense the presence of a nearby user, who may be preparing to use the shredder 10. Power may also be dissipated across inactive components such as the motor 18 or the power supply. Although the motor 18 may not be running, leakage current may still flow across it. Power supply components of the primary power source, such as a transformer, may also dissipate power in a standby mode. Other electronic components, such as a display screen, speaker, sensors, wireless transceivers, capacitors used in electromagnetic interference (EMI) filtering, and safety components may also draw power in standby mode. EMI filtering capacitors include X/Y capacitors that may allow leakage current to flow even in standby mode. Safety components include components designed to dissipate power. For example, bleed resistors in parallel with the X/Y capacitors may draw current from any charge that has built up at the capacitors. Other safety components include transorbs (transient voltage suppression diodes) and MOV's (metal oxide varistors), which may generally leak current even in standby mode or may intentionally draw current to reduce voltage levels.

To substantially reduce standby power, a power isolation circuit 300 of the shredder 10 may enter a power down mode, by disconnecting all or some electronic components of the shredder 10 from the primary power source 200. A power down mode may refer to a power mode in which power being consumed by the shredder 10 from a primary power source, such as from a wall outlet, may be reduced to zero, to the order of a few milliwatts, or to the order of tens of milliwatts.

The power down mode may also be considered a zero watt mode if the power consumption is less than 5 mW. In the power down mode, the disconnected components may include functional components such as the motor 18, user inputs, user outputs, and sensors. The disconnected components may include electronic components such as a power isolation controller and sensors that enable the power isolation circuit 300 to restore power to wake up from the power down mode. For example, power isolation circuit 300 may disconnect a common current path for receiving primary power shared by the power isolation controller 310, the throat sensor, and other electronic components. The power isolation controller 310 of the power isolation circuit 300 may generate control signals that cause the power isolation circuit 300 to electrically disconnect electronic components, including controller 310, from the primary power source 200 or to electrically reconnect shredder components to the primary power source 200.

When the power isolation circuit 300 disconnects its power isolation controller 310 from the primary power source, processors, memories, or other circuits that may be in the controller 310 may be powered by the auxiliary power source. Connecting an electrical component to a power source refers to providing a conductive path to the electrical component so that it is part of a closed loop that allows current to flow from the power source to the component. The path may include other electrical components, including another power isolation circuit, placed in series with the electrical component. Disconnecting an electrical component from a power source refers to temporarily breaking the conductive path. The path may be broken by a mechanical or electromechanical switch, or may be broken by a switch which has no moving components, such as a solid state switch. After the power isolation circuit 300 breaks the electrical path to disconnect the primary power source from the electrical component, a small amount of power from the primary power source, on the order of several milliwatts or tens of milliwatts, may still leak across the power isolation circuit 300 to the electrical component.

An auxiliary power source 400 may be provided to power electronic components such as the power isolation controller 310 when they are disconnected from the primary power source 200. The auxiliary power source 400 may power the electronic components only when primary power is disconnected, or may continue to power the components even after primary power is restored. The size and complexity of the auxiliary power source 400 may be varied based on its power requirements. For example, the auxiliary power source 400 may be adapted to supply only enough power for minimally necessary resources in the power down mode. Minimally necessary resources may include the power isolation controller 310, shown in FIG. 2A. Minimally necessary resources may include a clock to track, for example, the time of day for later display to a user or statistics related to the amount of time the shredder 10 is in a power down mode. If the shredder 10 has only limited non-volatile memory, portions of volatile memory that cannot be backed up to the non-volatile memory may be considered as a minimally necessary resource and be powered by the auxiliary power source 400. Minimally necessary resources are not limited to the examples discussed above, nor is the auxiliary power source 400 limited to powering only minimally necessary resources. Various sensors, memories, user inputs and outputs, and other components may be powered by the auxiliary power source 400. Powering these components with the auxiliary power source 400 allows the primary power source to be disconnected from all electronic components of the shredder 10. The power output requirements of the auxiliary power source 400 may be substantially less than that of the primary power source 200, however, because the auxiliary power source 400 may not need to power components such as the motor 18 or the pump drawing lubricating fluid for the shredder 10.

The auxiliary power source 400 may generate power, store power, or perform both actions. FIG. 2A shows an auxiliary power source 400 with a battery 410 that may store power generated by the auxiliary power source 400, store power supplied by the primary power source 200, or both. Although a battery is shown, any other energy storage device, such as a capacitor or inductor, may be used to store power. The battery 410 may be recharged by the primary power source 200 when the primary power source 200 is electrically connected to the battery 410. The battery 410 may draw charging power only when the shredder 10 is being actively used, or may continue to draw charging power in standby mode. The battery 410, along with the motor 18, and other electronic components, may be disconnected from the primary power source 200 by the power isolation circuit 300 when the shredder 10 is in the power down mode. The battery 410 may alternatively be recharged by an energy harvester of the auxiliary power source 400. In the power down mode, the battery 410 may power shredder resources such as the power isolation controller 310, sensors, clocks, and other electronic components. When power is restored by the isolation circuit 300, FIG. 2A shows that the primary power source 200 may provide power to the power isolation controller 310 indirectly, through the battery 410 that is connected in series with the controller 310. The primary power source 200 may also bypass the battery 410 to provide power through a direct, parallel connection to the controller 310.

The energy level in the battery 410 may be monitored by the power isolation controller 310. For example, if the voltage or state of charge of the battery 410 is close to a threshold minimum needed to operate minimally necessary resources of the shredder, or to some other threshold level, the power isolation controller 310 may command the power isolation circuit 300 to restore power to the shredder so that the battery 410 can be recharged. The shredder 10 may charge the battery 410 in a standby mode or some other power mode. If the power isolation circuit 300 reconnects the primary power source 200, the recharging of the battery 410 may be timed or monitored to allow the isolation circuit 300 to disconnect the battery 410 and other electronic components again after a fixed period of charging or after the battery's 410 voltage or state of charge has reached or risen above a certain threshold.

Figure 2B:
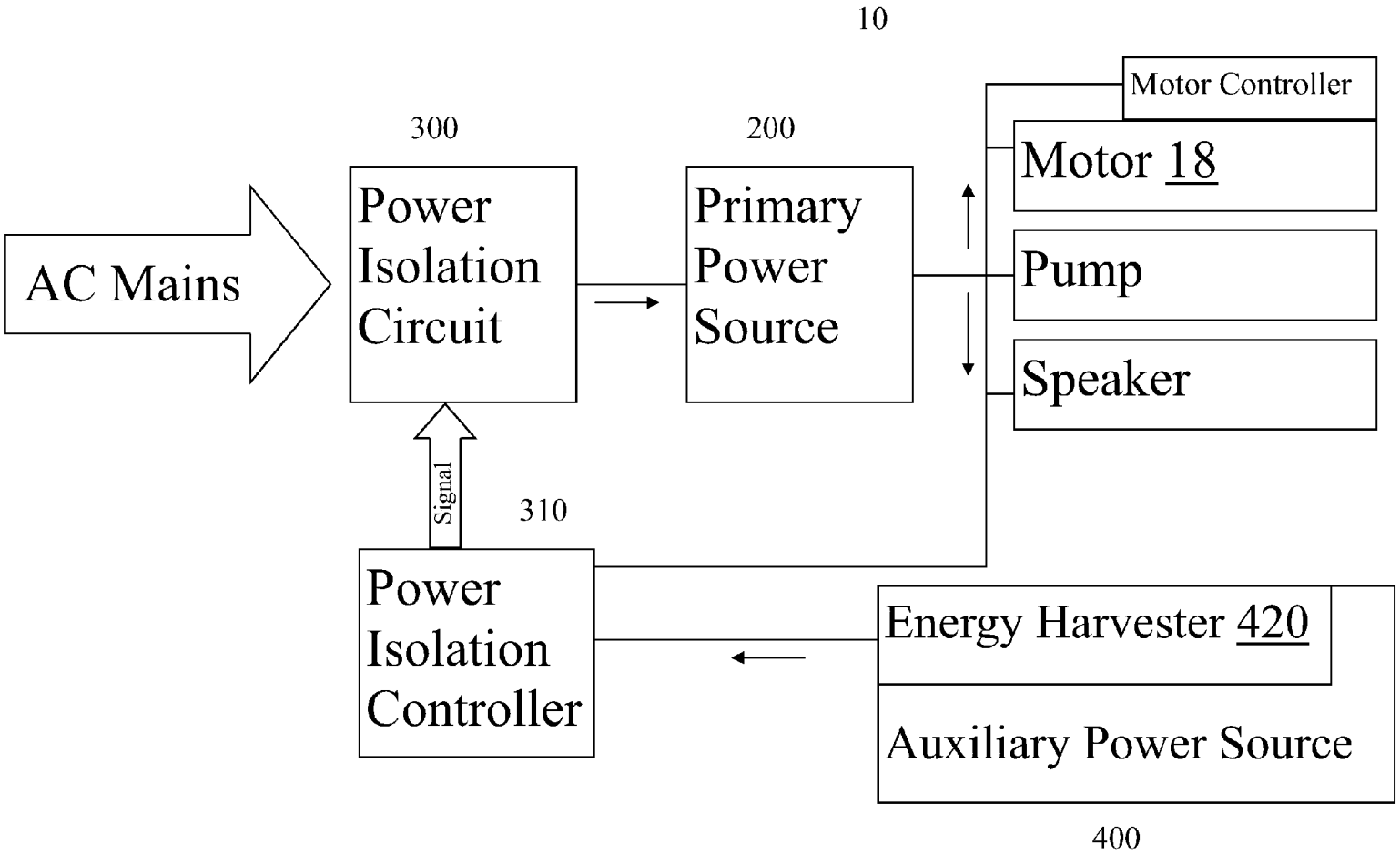
FIG. 2B illustrates a block diagram of alternative components for reducing standby power in a shredder.

The auxiliary power source 400 may also operate without a battery, as shown in FIG. 2B. An energy harvester 420 may directly supply generated power to electronic components such, as the power isolation controller 310, without recharging any batteries. The energy harvester may generate power from a source different from the primary power source. An energy harvesting source is different from the primary power source if, for example, the energy being harvested does not directly come from AC mains or from the primary power source. The energy being harvested may have been converted, however, from the electrical energy of AC mains or the primary power source. For example, the energy harvesting source may be heat or kinetic energy created by power from the primary power source. The energy being harvested may also come from other forms of energy, such as solar energy derived from a photovoltaic device. The amount of power being outputted by the energy harvester 420, the battery 410, or another auxiliary power source may be at a level substantially lower than the power supplied to the shredder by the primary power source 200. For example, the energy harvester 420, battery 410, or another auxiliary power source may be configured to output power on the order of a few watts or in a range that is from a few milliwatts to a few watts. In one example, the auxiliary power source may be configured to output power at 0.1 watts and output current at 20 milliamps. In another example, the power source may be configured to output power in a range of 0.1 to 0.5 watts or 0.01 to 1.0 watts, and may be configured to output current at a level of 20 to 100 milliamps or 2 to 200 milliamps. These ranges are only examples, and other output ranges may be used. For example, the auxiliary power source may be configured to output ~3 mA at 5 V (15 mW) when a processor and interaction sensor on the shredder needs to be powered. The auxiliary power source may be configured to dynamically increase the power output (e.g., to ~10 mA at 5V (50 mW)) to additionally power a paper thickness sensor and power isolation controller components. The power isolation controller 310 may monitor the amount of power being output by the energy harvester 420. If the power output falls below a threshold level, the controller 310 may command the isolation circuit 300 to restore power to the shredder 310. The shredder may enter the standby mode or other mode after power is restored by the isolation circuit 300.

FIG. 2B also illustrates placement of the power isolation circuit 300 between AC Mains and the primary power source 200. For example, the power isolation circuit 300 may be placed between the power cord 47 and the power supply of the primary power source 200. Electronic components able to withstand the voltage and current levels from AC mains, such as a contactor, may be provided in the isolation circuit 300. The power isolation circuit 300 may also be placed after any transformer of a primary power source 200, but before any rectifier of the primary power source 200. The isolation circuit 300 is not limited to the circuit locations described above, but may be placed anywhere along the conductive path from an external or internal power source to electronic components in the shredder 10.

Figure 3A:
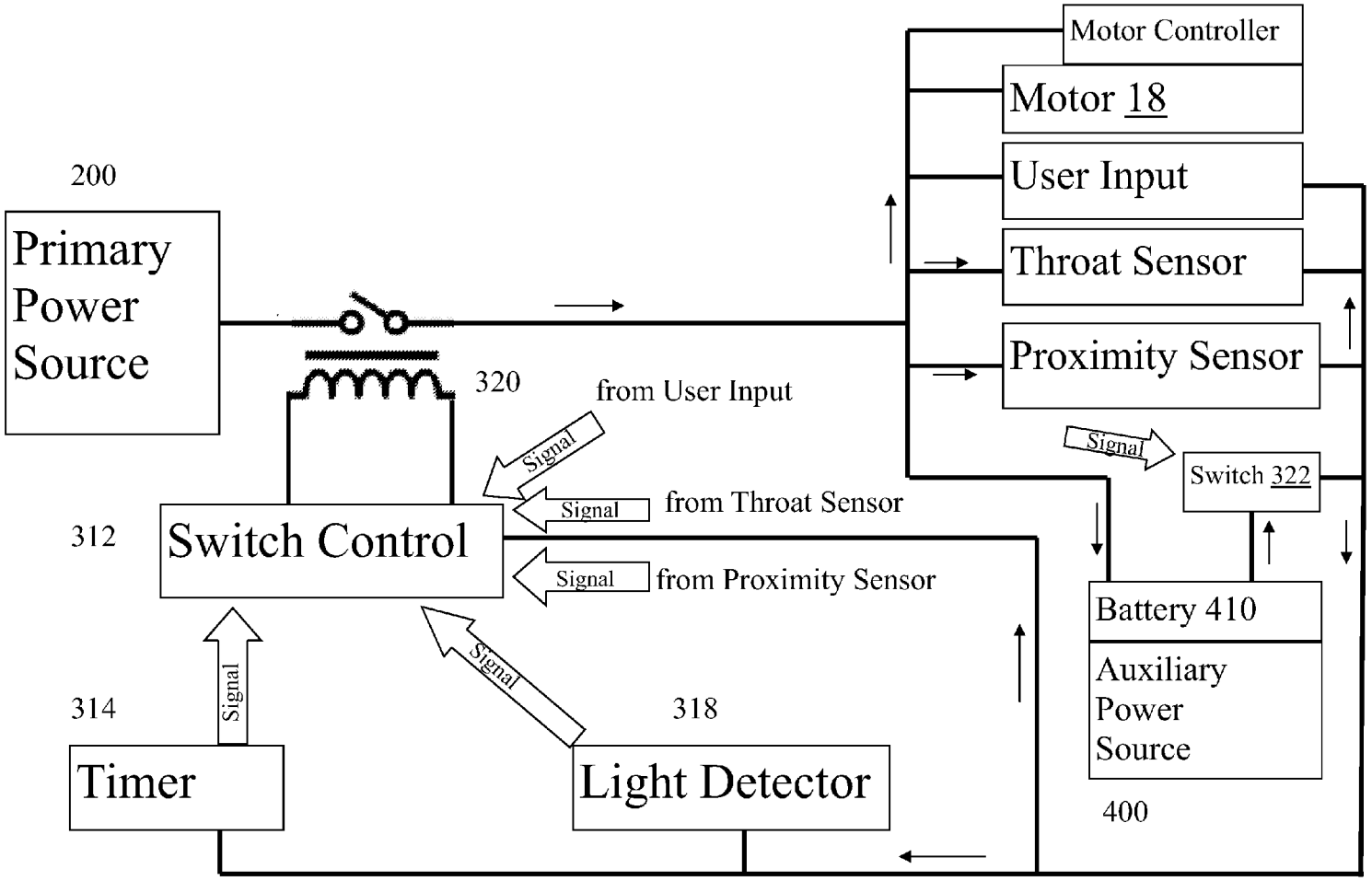
FIG. 3A illustrates a block diagram of components of a power isolation controller for a power isolation circuit.

FIG. 3A illustrates a block diagram of one embodiment of a power isolation circuit 300 and its power isolation controller 310. The isolation circuit 300 may contain a switch, such as a relay 320 used to electrically connect and disconnect electronic components such as the shredder's motor 18, user input, and throat sensor from a primary power source. The relay 320 may be a latching relay, a reed relay, any other electromechanical relay, a solid state relay, or any other type of relay. The isolation circuit 300 may also use any other type of switch that is configured to switch between a conductive state and a high impedance state based on a control signal. For example, switching components from a LinkZero™ 225ci power supply board may be used. In another example, switching components may comprise a network of one or more FET's, TRIAC's, or both types of components.

The control signal may be a voltage or current pulse directly applied to the switching component, a modulated signal that capacitively or inductively couples to the switching component, or some other type of control signal. The switching component may include, for example, a photosensitive diode configured to receive optical and other forms of wireless control signals.

The relay 320 or other switch may be placed in series with any mechanical switches of the shredder 10. For example, a manual on/off switch 42, as shown in FIG. 1, may be placed in series with the power isolation circuit 300 to allow a user to manually disconnect or connect the shredder 10 to the primary power source 200. The manual switch may have a user-engageable portion 46 that mechanically moves electrical contacts between an on position in which an electrical circuit is closed to an off position in which the electrical circuit is open.

FIG. 3A shows that electronic components of the power isolation controller 310, such as the switch control 312, timer 314, and light detector 318, are powered by only the auxiliary power source 400, but these components may also be powered by the primary power source 200 when the shredder is in an active or standby mode. Other electronic components of the shredder 10, such as a memory or user input, may also be powered by the auxiliary power source 400 in a power down mode. For example, a soft touch on/off button may be powered by the auxiliary power source 400 so that a user may touch the button to bring the shredder 10 out of a power down mode. A switch 322 may connect electronic components to the auxiliary power source 400 when the shredder is in a power down mode, and may disconnect the electronic components from the auxiliary power source 400 when the shredder is in an active or standby mode. The operation of switch 322 may be synchronized with the operation of switch 320. The switch 322 may be controlled by the switch control 312, or by another control device, such as a logic circuit, firmware, software, and/or any other control circuit. The switch 322 may comprise a relay, a FET, a TRIAC, and/or any other switching component.

Figure 3B:
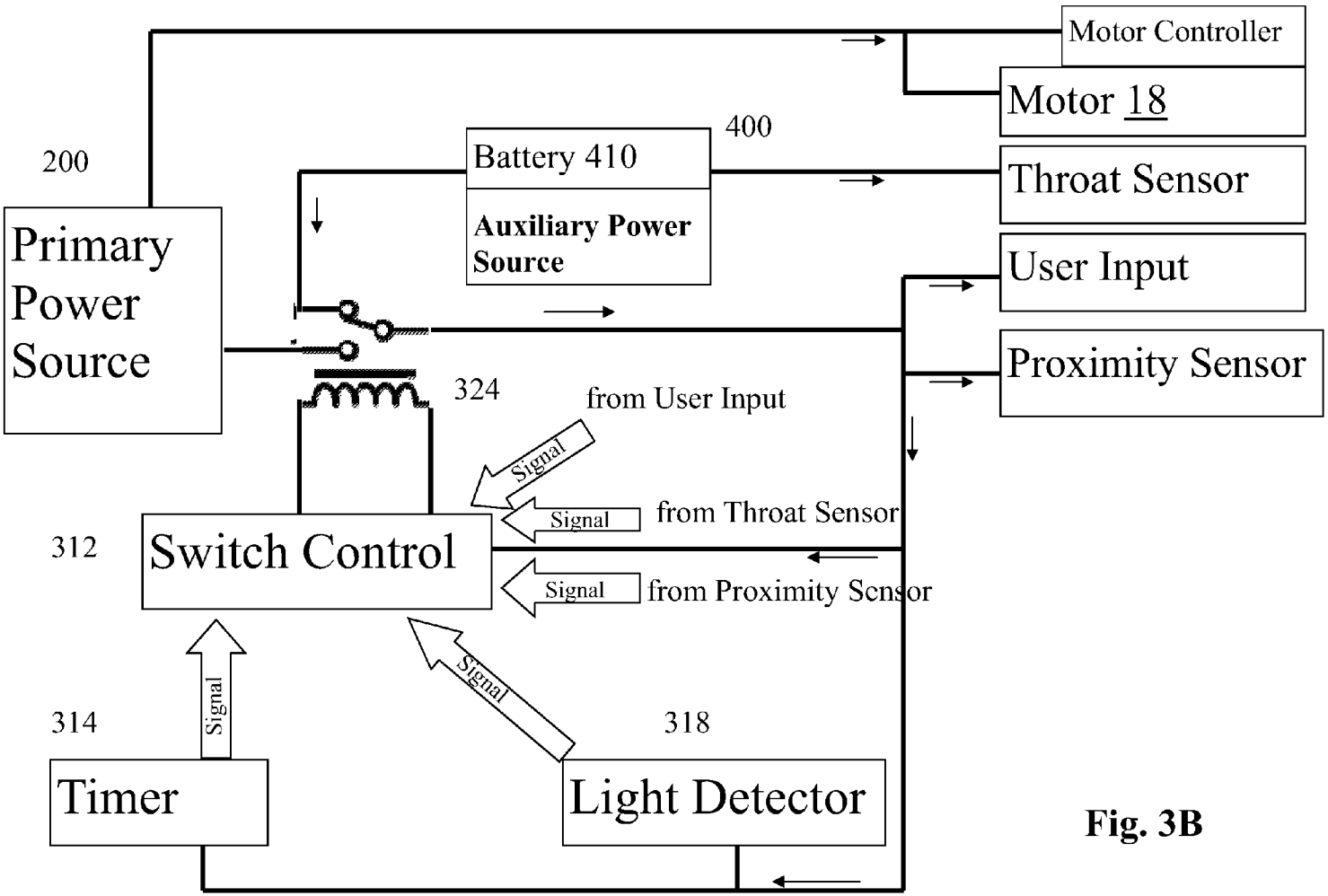
FIG. 3B illustrates a block diagram of components of a power isolation controller for a power isolation circuit.

FIG. 3B illustrates an embodiment a power isolation circuit 300 and its power isolation controller 310. The isolation circuit 300 may contain a switch 324 used to electrically connect and disconnect electronic components, such as a user input and proximity sensor, from the primary power source 200. The switch control 312 may switch between powering the electronic components with the primary power source 200 and powering the electronic components with the auxiliary power source 400. In one example, all electronic components are switched between the primary power source 200 and the auxiliary power source 400. In one example, one or more electronic components are powered by only one of the power sources. The motor 18, for example, may be powered by only the primary power source 200. In the example, the motor 18 may draw zero or only a few milliwatts of power in a standby or power down mode. The throat sensor, for example, may be powered by only the auxiliary power source 400. The switch 324 may include a relay, TRIAC, FET, and/or any other switching component.

Figure 4:
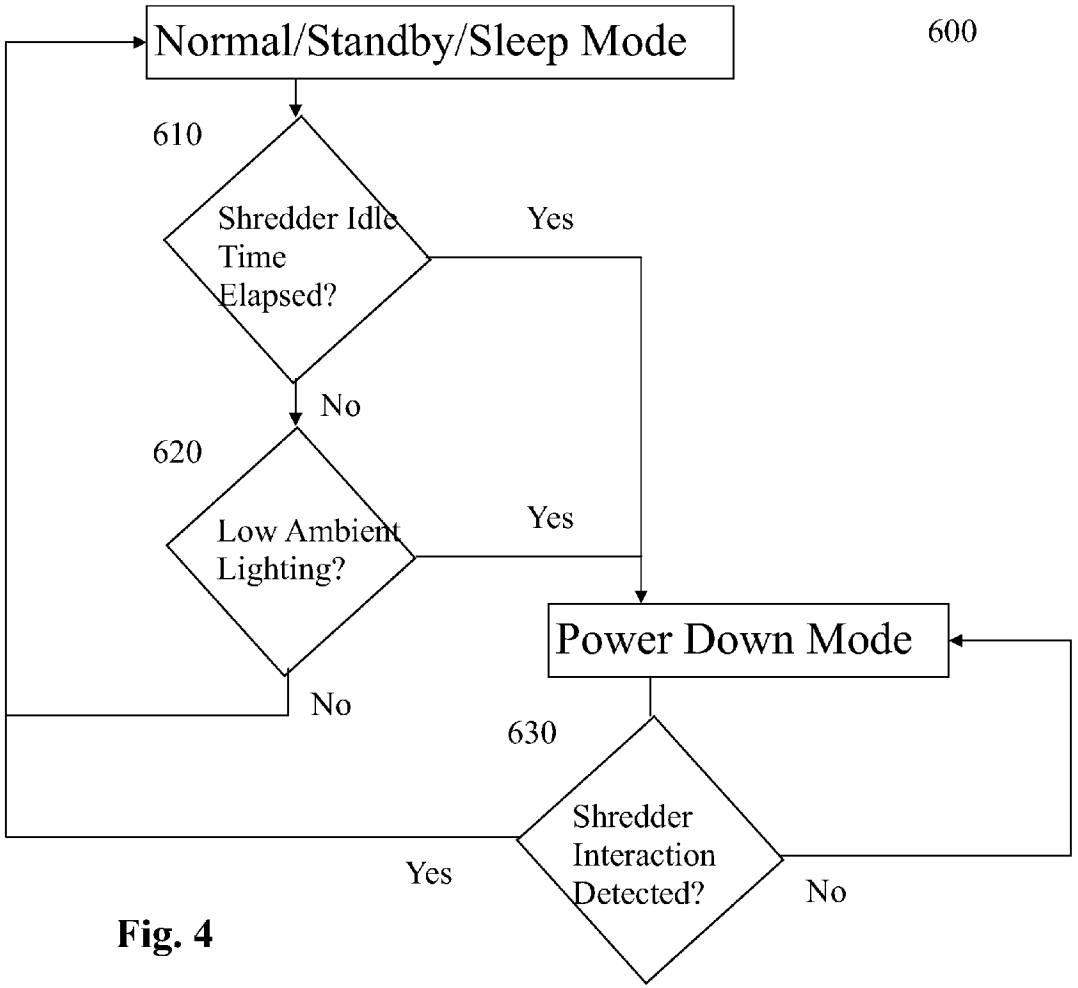
FIG. 4 illustrates a flow diagram of a transition from a normal power mode or a low power mode to a power down mode.

The power isolation controller 310 may include a switch control 312 that generates control signals to switch the relay 320 between a conductive state, corresponding to a normal, sleep, or standby mode of the shredder 10, and non-conductive state, corresponding to a power down state. The switch control 312 may be implemented as firmware or another form of a logic circuit, such as a processor. In the embodiments in FIGS. 3A and 3B, the switch control 312 may detect whether the shredder 10 is inactive in order to generate a signal to place the shredder 10 in a power down mode. FIG. 4 illustrates operations 600 in the shredder's transition between a power down mode and a power mode in which the primary power source 200 is connected to shredder components. At operation 610, the isolation controller 310 may decide whether to transition from a normal or standby or sleep mode to a power down mode. The normal, standby, and sleep modes refer to various levels by which the primary power source 200 supplies power to connected electronic components of the shredder 10. The modes may have different levels of power consumption. For example, a fan on the shredder may be running in normal mode, but not in standby or sleep mode. LED's or other lights may be on in standby mode, but not in sleep mode. At operation 610, the controller 310 may detect whether the shredder is inactive based on an amount of time that the shredder 10 has been idle. The controller 310, such as through the switch control 312 of FIG. 3A, may use the timer 314 to track elapsed time since a user input on the shredder 10 was last manipulated. The switch control 312 may also use the timer 314 with the proximity sensor to track the elapsed time since a nearby user or other object was last detected. The switch control 312 may also use the timer 314 with the throat sensor to track the elapsed time since a user last inserted an article into the shredder's throat. If a threshold amount of time has elapsed since the last interaction, the switch control 312 may conclude that the shredder 310 is inactive and generate a signal to place the shredder 10 in a power down mode.

If the threshold amount of time has not elapsed, the switch control 312 may still decide whether to place the shredder 10 in a power down mode based on the level of ambient light. At operation 620, the switch control 312 may use the light detector 318 in FIG. 3A to detect the amount of ambient light in the shredder's 10 environment. If low ambient lighting is detected, the switch control 312 may conclude that the surrounding office or room is dark and therefore presumably unoccupied. The switch control 312 may therefore conclude the shredder 10 is not being used and enter a power down mode. The lighting detector in FIG. 3A draws power from the auxiliary power source 400 to, for example, amplify its signals. In another embodiment, the light detector 318 may be powered solely by the ambient light and draw no power from the auxiliary power source 400. If the ambient lighting is low, the detector 318 may simply output no signal to the switch control 312, which may respond to the absence of an output from the detector 318 by entering the power down mode.

At operation 630, the isolation controller 310, which continues to receive power from the auxiliary power source 400, may monitor for a condition that triggers exiting of the power down mode. The operation may signal the existence of an exit condition after a predetermined amount of time has elapsed in the power down mode. The operation may base an exit condition on whether detected user interactions that indicate use of the shredder 10 is about to resume. The switch control 312 may use the proximity sensor, for example, to detect whether a user is approaching the shredder. The switch control 312 may use the throat sensor to detect whether a user is inserting an article for shredding into the throat. The switch control 312 may use the light detector 318 to detect whether a light in the shredder's environment has been turned on. The switch control 312 may also use signals from the shredder's soft-touch controls to detect whether a user is attempting to input commands to the shredder 10. The switch control 312 may use one or a combination of the above-described sensors. If the switch control 312 or another component of the controller 310 concludes at operation 630 that user interaction with the shredder 10 has been detected, the shredder controller 310 may transition out of the power down mode.

Figure 5A:
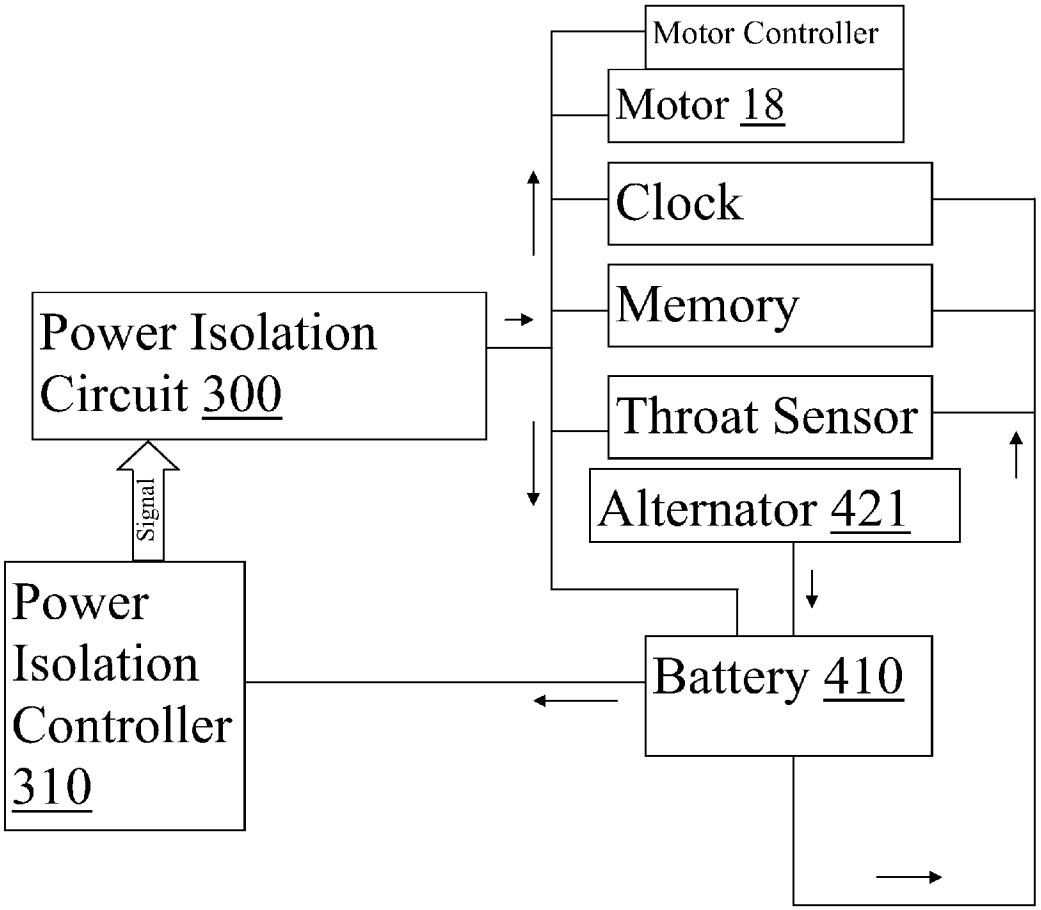
FIG. 5A illustrates some components of an auxiliary power source of an electrical appliance.

FIG. 5A illustrates an embodiment of the auxiliary power source 400. The auxiliary power source 400 may supply power to the power isolation controller 310 and other electronic components of the shredder 10, such as a memory, clock, throat sensor, proximity sensor, or any other electronic component that is able to operate from the level of the auxiliary power source's power output. FIG. 5A shows that the electronic components may be powered by a primary power source when the power isolation circuit 300 connects the primary source to the components. Alternatively, some of the components may be powered at all times by the auxiliary power source 400. The auxiliary power source may generate power through an energy harvester 420, which may store the power in and indirectly supply the power through the battery 410 or directly supply power to electronic components. FIG. 5A shows an energy harvester 420 in the form of an alternator 421. The alternator 421 may generate power while the motor 18 is running in a normal power mode of the shredder 10 and store the power when the shredder 10 is later powered down. The alternator 421 may include, for example, a rotor component attached to the motor shaft or motor housing and include a stationary stator. A magnet or other source of magnetic field may be included in the rotor. The rotor may be attached to a surface of the motor 18 or may be placed inside the motor 18 housing. The stator may have windings that may be placed beside the motor 18 or that may surround the motor 18. The alternator 421 may also include a diode to rectify output current into DC current. In another embodiment, the energy harvester 420 may use a generator that includes an armature component attached to the motor 18 and a magnet or other source of magnetic field that is stationary. The generator may include a commutator component, such as a brush, that electrically connects the armature to a rechargeable battery 410.

The energy harvester 420 may include any other components that convert the motion of the motor 18 into electrical power.

Figure 5B:
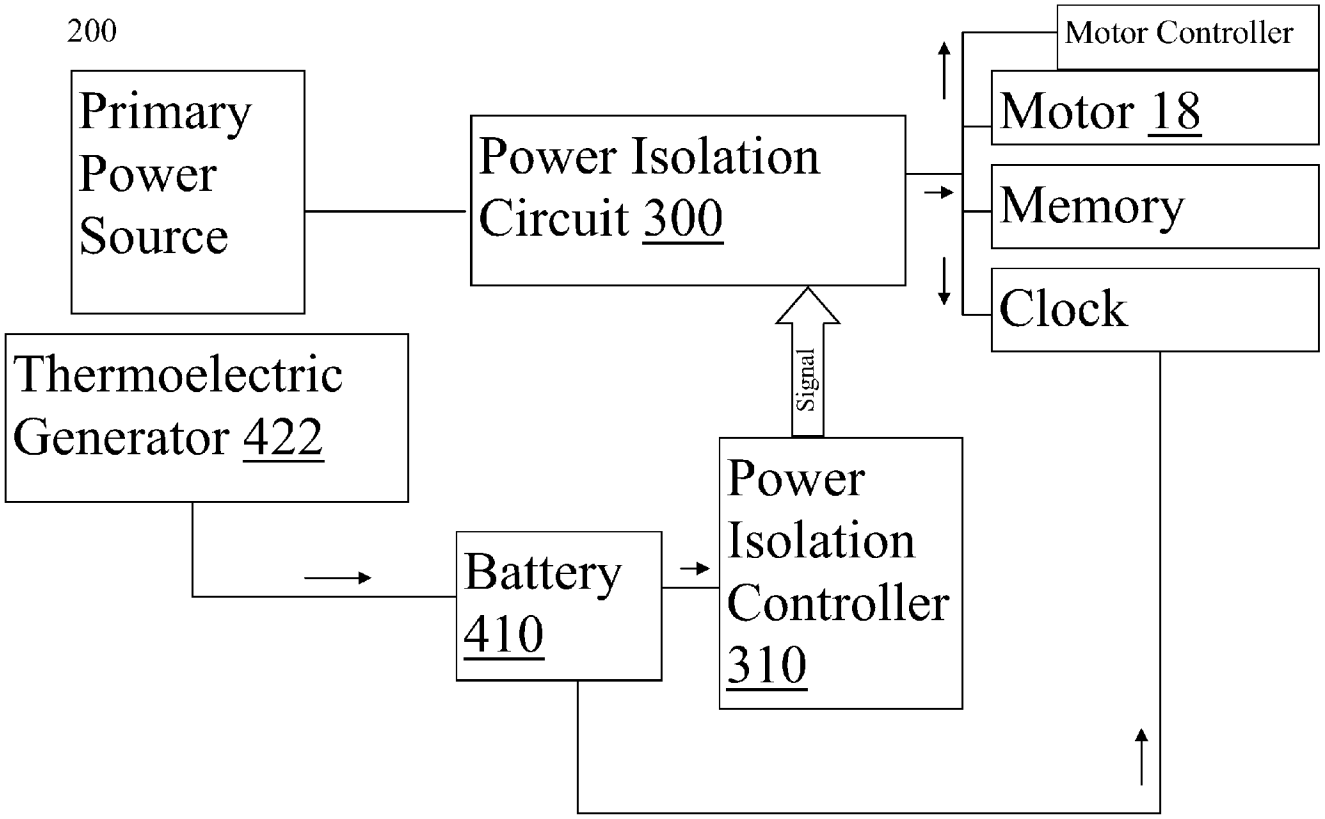
FIG. 5B illustrates some components of an auxiliary power source of an electrical appliance.

FIG. 5B illustrates an energy harvester 420 in the form of a Seebeck generator 422 or any other type of thermoelectric generator. The generator 422 may be placed by any source of temperature gradient in the shredder 18. The source may be a heat source, such as the power supply of the primary power source 200, the motor 18, or some other heat source. Placing the thermoelectric generator 422 next to the power supply or the motor 18 may allow it to partially recycle power that had been dissipated by the power supply as heat. The generator 422 may be placed, for example, between the heat source of the power supply and a fan of the power supply or some other location or orientation to maximize the temperature gradient across the generator 422. The generator 422 may include semiconductor materials that form a thermocouple to generate electric power, or any other type of material that converts temperature gradients into electric power. The size of the thermoelectric generator 422 may be controlled by controlling its power output requirement. For example, FIG. 5B shows that the thermoelectric generator 422 may be required to power only the power isolation controller 310 and a system clock on the shredder. In the example, the isolation controller 310 may base the transition into and out of the power down mode on lighting conditions or elapsed time, and not on the throat sensor or proximity sensor. The size of the generator 422 may be increased to generate more power for other electronic components, such as the memory shown in FIG. 5B.

Figure 5C:
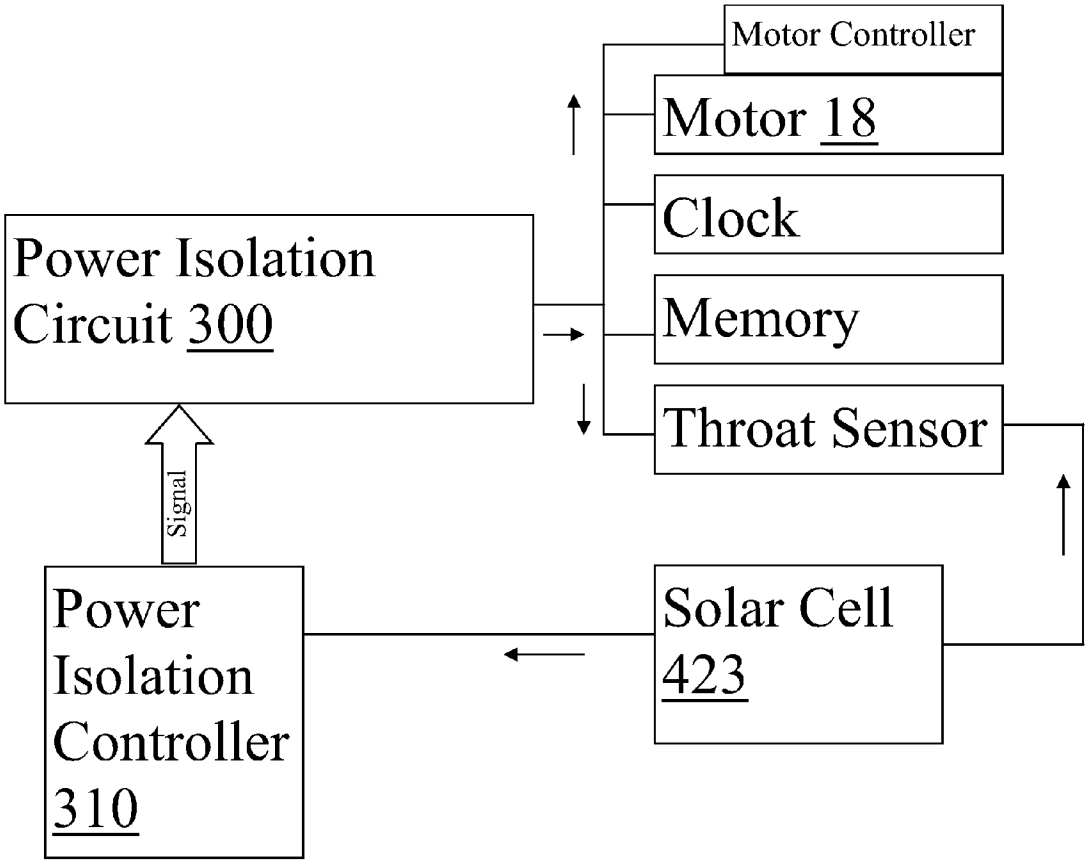
FIG. 5C illustrates some components of an auxiliary power source of an electrical appliance.

FIG. 5C illustrates an energy harvester 420 in the form of a solar cell 423. The solar cell 423 may be placed on the outside of the shredder 10. It may be constituted by or combined with the light sensor 318 of FIG. 3A or may be a separate component. Although the figure illustrates the solar cell 423 to directly supply generated power to electronic components, the cell 423 may also indirectly supply the generated power through a battery, supercapacitor, or other energy storage device. When the solar cell 423 supplies power without a battery, it may be able to generate power quickly enough to power the controller 310 and any sensors shortly after there is sufficient ambient light. For example, when the shredder's environment becomes dark and it enters a power down mode, the solar cell 423 may simply provide no power to the power isolation controller 310 or any other component. Because the dark environment is likely unoccupied, resumed use of the shredder 10 in the dark is unlikely and the power isolation controller 310 may not need to operate. Resumed use may involve, for example, a user entering the environment and turning on a light or returning in the daytime. The solar cell 423 may then generate power to allow the power isolation controller 310 and other components to operate. For example, the sensor 318, proximity sensor, throat sensor, and switch control 312 of FIG. 3A may be able to initialize and operate in a few seconds or less. By the time the user who turned on the light approaches the shredder, the proximity sensor and throat sensor may be ready to detect interactions with the shredder 10. The energy harvester 420 is not limited to the examples discussed herein, but may include a hand crank, a wound spring device, a piezoelectric transducer, or any other device configured to generate power from a source that is not directly from the primary power source. As discussed above, the energy harvester 420 could be used alone or in combination with a battery or other energy storage device. The battery or energy storage device may be rechargeable and receive power from the energy harvester 420, or may be nonrechargeable and replaceable by a user. A nonrechargeable or rechargeable battery may provide power to the power isolation controller 310, for example, when the amount of power being generated by the energy harvester 420 is low.

While the shredder's environment 10 was dark, electronic components such as the clock and memory may also receive no power from the solar cell 423. The clock, for example, may be powered by another harvester of the auxiliary power source 400. Alternatively, the clock may be left unpowered in a power down mode. When the shredder returns from a power down mode, it may synchronize the time with a server or other external source using a wireless receiver.

Figure 6:
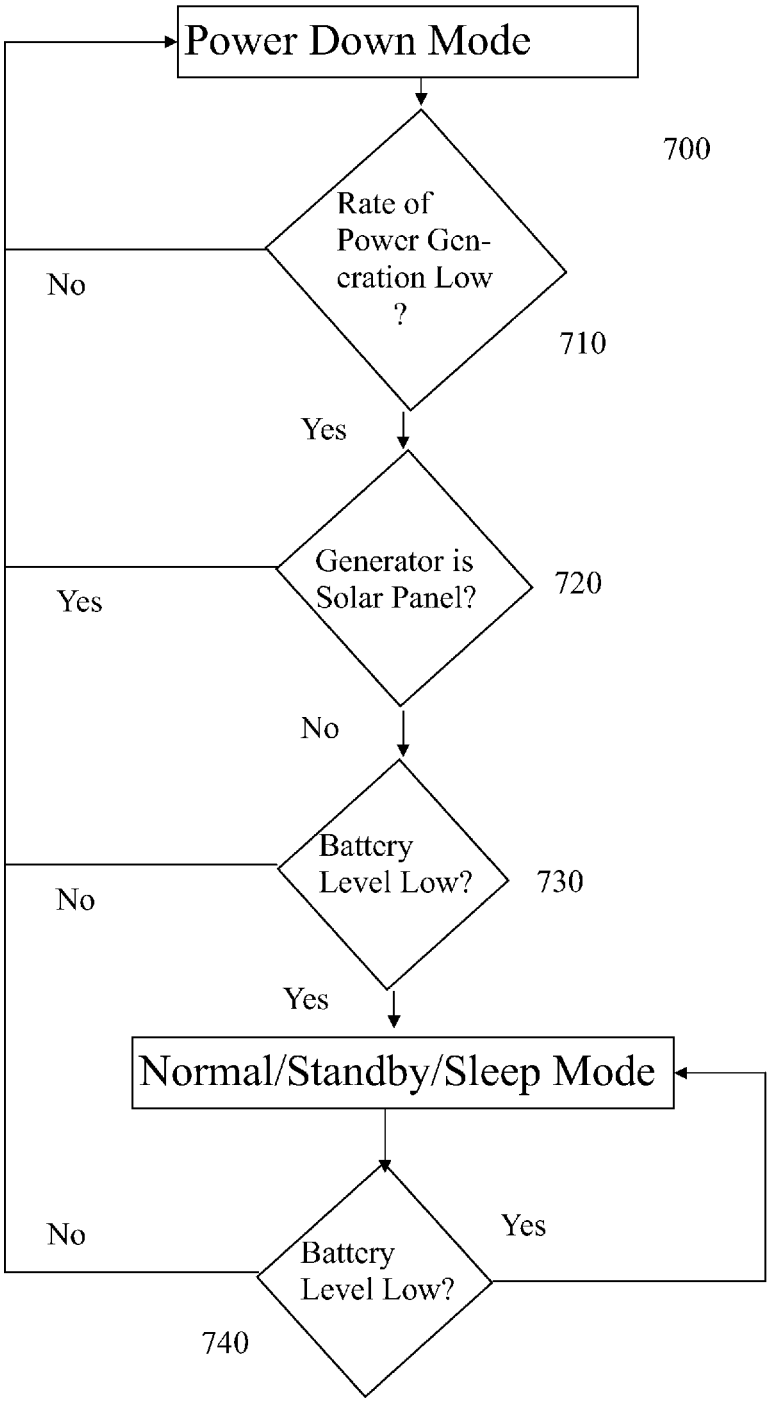
FIG. 6 illustrates a flow diagram of a transition between a power down mode and a normal power or low power mode based on power levels of an auxiliary power source of an electrical appliance.

The power isolation controller 310 may monitor the power level stored or generated by the auxiliary power source 400 to determine whether primary power should be restored to charge a battery 410 on the auxiliary power source 400 or to power the shredder 10 until an energy harvesting condition (e.g., a temperature gradient) is detected. A flow diagram of the transition operations 700 into and out of a power down mode is illustrated in FIG. 6. At operation 710, the shredder may be in a power down mode. The power isolation controller 310 may monitor the rate of power being generated by any energy harvesters of the auxiliary power source 400. If the rate of power generation is sufficient to power minimally necessary resources, for example, on the shredder 10, the isolation controller 310 may decide to remain in the power down mode.

If the rate of power generation is insufficient, the isolation controller 310 may determine at operation 720 whether the energy harvester 420 is a solar panel 423. A solar panel 423 in a dark room, for example, may be outputting insufficient power, but the dark room is likely unoccupied and the shredder is therefore likely not being used. Because a user entering the room is likely to turn on a light or is likely to wait until business hours, when there is daylight in the room, the solar panel 423 will likely be able to generate enough power for the power isolation controller 310 and other electronic components needed to resume use of the shredder 10. Therefore, at operation 720, the controller 310 may decide that the solar panel 423 will be able to later generate enough auxiliary power such that primary power is not needed. The shredder 10 may therefore remain in the power down mode. If the isolation controller 310 determines that a solar panel is not among the energy harvesters in the auxiliary power source 400, it may determine the battery level, such as a voltage or state of charge, at operation 730. For example, an alternator 421 in a power down mode may be generating no power, and a thermoelectric generator 422 may be generating a low level of power, but if the battery 410 that they charged still has a sufficient level of charge or voltage, however, the isolation controller 310 and other components may continue to draw power from the battery and not restore primary power. If the battery level is low, the isolation controller 310 may restore power by generating a control signal that causes the isolation circuit 300 to reconnect the shredder components to the primary power source 200.

When primary power is restored, the shredder 10 may enter a normal mode, a standby mode, or a sleep mode. The shredder 10 may stay in that mode until a condition suitable for an energy harvester 420, such as a temperature gradient for a thermoelectric generator, is detected. FIG. 6 illustrates that the shredder 10 may also stay in the normal, standby, or sleep mode until the battery 410 of the auxiliary power source 400 is charged to a sufficient level. At operation 740, the isolation controller 310 may generate a control signal for the isolation circuit 300 to disconnect primary power if the battery level has been sufficiently recharged.

Figure 7:
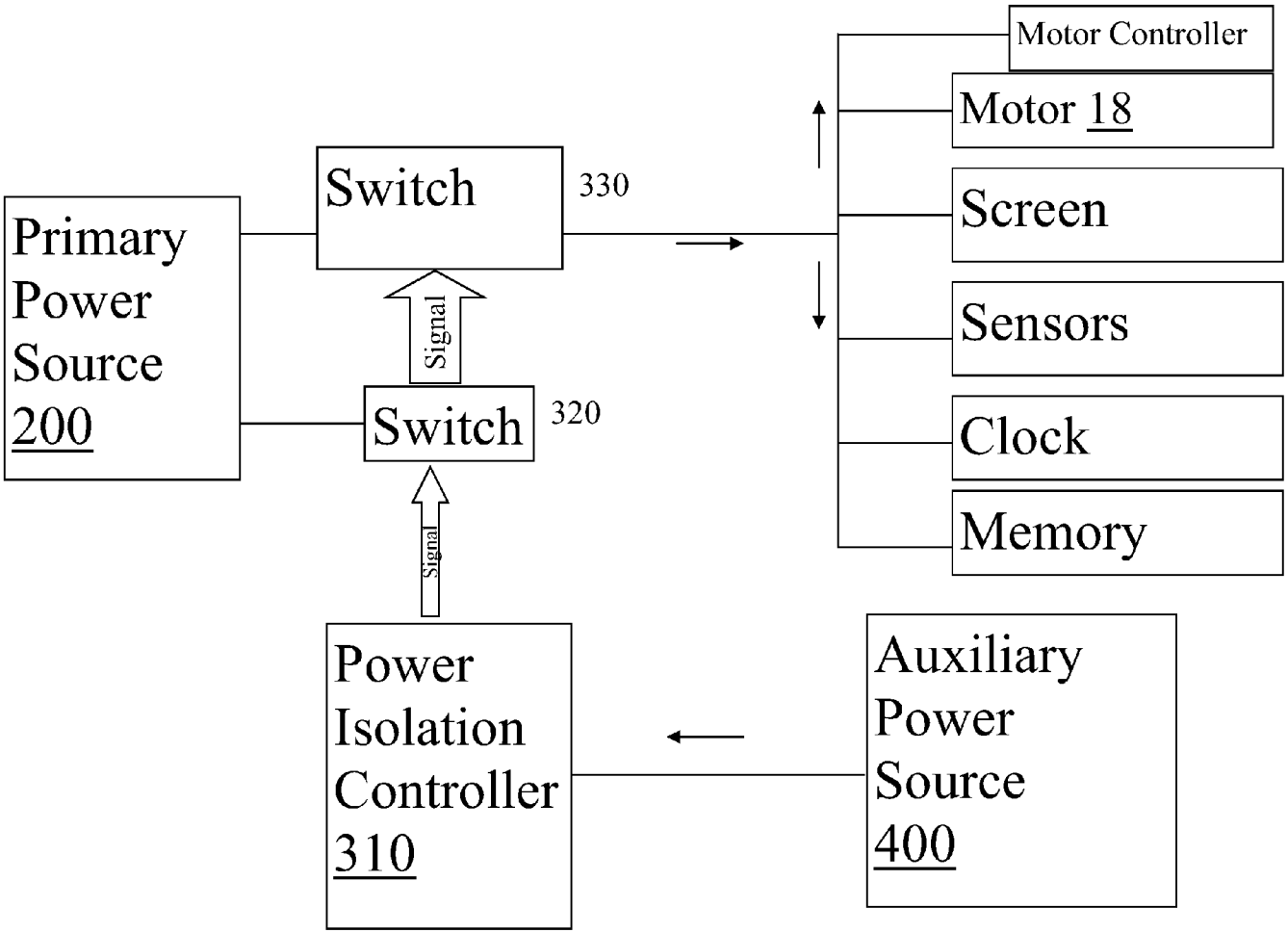
FIG. 7 illustrates an electrical appliance that may use more than one switching component to disconnect the appliance from a power source.

The power isolation circuit 300 may use one, two, or more switching components. Some, none, or all of the switching components may be a relay. FIG. 7 illustrates an embodiment of an isolation circuit 300 that uses two switching components. The switch 330 may be able to connect and disconnect a higher voltage or current than the switch 320, but may also require a higher level of power to control. If the power output of the auxiliary power source 400 is not sufficiently high to control the switch 330, it may be used to instead control the switch 320. A control signal powered by the auxiliary power source 400 may turn on switch 320, which may then route power from the primary power source 200 to power switch 330. If the power output of the auxiliary power source 400 is sufficiently high to control the switch 330, however, only one switch may be needed for the power isolation circuit 300.

While the particular appliance illustrated in the embodiments above is a shredder, the primary power source 200, power isolation circuit 300, and auxiliary power source 400 may be used to reduce standby power in any electronic appliance, such as a computer, TV, copier, fax machine, or some other electronic device. For example, the power isolation circuit 300 may place a TV or a computer from a standby mode into a power down mode. In the power down mode, a solar cell in a lighted room or thermoelectric generator may provide auxiliary power to the power isolation controller 310 of the isolation circuit 300 and to other electronic components of the TV.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed:

1. A shredder, comprising:

a motor configured to receive power from a primary power source;

a shredder mechanism driven by the motor;

a processor;

a housing in which the motor, processor, and shredder mechanism are located, the housing including a throat for feeding at least an article into the shredder mechanism;

a user interaction sensor configured to sense an interaction with the shredder;

an auxiliary power source electrically connectable to the user interaction sensor and configured to output power at a level substantially lower than the power received by the motor from the primary power source; and a switch switchable between a conductive state and an isolating state based on a signal from the user interaction sensor, wherein the processor is configured to receive power from the primary power source through the switch when the switch is in the conductive state, the switch is operable to electrically isolate the processor from the primary power source when the switch is in the isolating state, and the switch switches from the electrically isolating state to the conductive state in response to the user interaction sensor sensing the interaction with the shredder.

2. The shredder of claim 1, wherein the user interaction sensor is electrically connectable to the auxiliary power source and electrically connectable to the primary power source through the switch.

3. The shredder of claim 1, wherein the processor is electrically connectable to the auxiliary power source through the switch.

4. The shredder of claim 1, wherein the auxiliary power source comprises a rechargeable energy storage device, and wherein the rechargeable energy storage device is at least configured to receive power from the primary power source through the switch, the switch operable to electrically isolate the rechargeable energy storage device from the primary power source and operable to electrically connect, in response to the user interaction sensor sensing the interaction with the shredder, the rechargeable energy storage device to the primary power source.

5. The shredder of claim 4, wherein the switch is configured to electrically connect the rechargeable energy storage device to the primary power source in response to a voltage or state of charge of the rechargeable energy storage device being at or below a threshold value.

6. The shredder of claim 1, wherein the auxiliary power source comprises an energy harvester configured to generate power from a second source that is different from the primary power source.

7. The shredder of claim 6, wherein the energy harvester is configured to generate power from the motion of the motor or from heat generated by the motor.

8. The shredder of claim 6, wherein the energy harvester comprises a solar cell.

9. The shredder of claim 8, wherein the switch is configured to electrically connect the user interaction sensor to the primary power source based on an ambient light level.

10. The shredder of claim 6, wherein the energy harvester comprises a thermoelectric generator configured to generate power from a variation in ambient temperature.

11. The shredder of claim 1, wherein the user interaction sensor is electrically connected to the auxiliary power source through a permanent electrical connection from the auxiliary power source to the user interaction sensor.

12. The shredder of claim 1, wherein the user interaction sensor is electrically connectable to the auxiliary power source through a second switch.

13. The shredder of claim 2, further comprising a user input, a user output, clock, memory, transceiver, pump, a second sensor, or any combination thereof, wherein the user input, user output, clock, memory, transceiver, pump, second sensor or any combination thereof is electrically connectable to the primary power source and the auxiliary power source through the switch.

14. The shredder of claim 2, wherein the user interaction sensor comprises an electronic throat sensor configured to sense the presence of an object in the throat, a proximity sensor, a motion sensor, a camera, a microphone, a touch screen, a touch button, or any combination thereof.

15. The shredder of claim 1, wherein the switch comprises an electromechanical or semiconductor relay.

16. A method of reducing power drawn by a shredder in a power down mode, the shredder having a processor, a shredder mechanism driven by a motor, and a housing in which the motor, shredder mechanism, and processor are located, the housing including a throat for feeding at least an article into the shredder mechanism, the method comprising:

electrically isolating the processor from a primary power source after completion of a shredding operation;

generating power from an auxiliary power source that is different from the primary power source, wherein the power generated from the auxiliary power source is substantially lower than the power received from the primary power source;

powering a user interaction sensor of the shredder with power generated from the auxiliary power source; and sensing, with the user interaction sensor, whether a user is interacting with the shredder.

17. The method of claim 16, further comprising electrically connecting the processor to the primary power source based on the user interaction sensor sensing the user interacting with the shredder.

18. The method of claim 17, further comprising powering the processor with power generated from the auxiliary power source when the processor is electrically isolated from the primary power source.

19. The method of claim 17, further comprising electrically isolating the user interaction sensor from the primary power source after completion of the shredding operation; and electrically connecting the user interaction sensor to the primary power source based on the user interaction sensor sensing the user interacting with the shredder.

20. The method of claim 19, wherein the generating power from the auxiliary power source comprises generating power from motion of the motor or from heat generated by the motor.

21. The method of claim 19, further comprising charging a rechargeable energy storage device with power generated from the auxiliary power source.

22. The method of claim 21, further comprising electrically connecting the processor to the primary power source based on a voltage or state of charge of the rechargeable energy storage device being at or below a threshold value.

23. The method of claim 16, wherein the generating power from the auxiliary power source comprises generating power with a solar cell, a thermoelectric generator configured to generate power from a variation in ambient temperature, or any combination thereof.

24. The method of claim 16, wherein the electrically isolating occurs after a predetermined amount of time has elapsed since completion of the shredding operation, occurs at a predetermined time of day, occurs when a level of ambient light is less than or equal to a predetermined threshold value, or occurs based on any combination thereof.

* * * * *